US010035114B2

(12) United States Patent
Choi et al.

(10) Patent No.: US 10,035,114 B2
(45) Date of Patent: Jul. 31, 2018

(54) MIXER

(71) Applicant: LG CHEM, LTD., Seoul (KR)

(72) Inventors: Jun Won Choi, Daejeon (KR); Ye Hoon Im, Daejeon (KR); Yu Shik Hong, Daejeon (KR); Young Soo Song, Daejeon (KR)

(73) Assignee: LG Chem, Ltd., Seoul (KR)

( * ) Notice: Subject to any disclaimer, the term of this patent is extended or adjusted under 35 U.S.C. 154(b) by 536 days.

(21) Appl. No.: 14/439,128

(22) PCT Filed: Feb. 28, 2014

(86) PCT No.: PCT/KR2014/001695
§ 371 (c)(1),
(2) Date: Apr. 28, 2015

(87) PCT Pub. No.: WO2014/133366
PCT Pub. Date: Sep. 4, 2014

(65) Prior Publication Data

US 2015/0273413 A1 Oct. 1, 2015

(30) Foreign Application Priority Data

Feb. 28, 2013 (KR) ..... 10-2013-0022222

(51) Int. Cl.
*B01F 5/10* (2006.01)
*B01F 5/06* (2006.01)
*B01F 13/10* (2006.01)

(52) U.S. Cl.
CPC ..... *B01F 5/10* (2013.01); *B01F 5/0602* (2013.01); *B01F 13/1016* (2013.01)

(58) Field of Classification Search
CPC ..... B01F 5/0602; B01F 5/10; B01F 13/1016
(Continued)

(56) References Cited

U.S. PATENT DOCUMENTS 4,472,215 A 9/1984 Binet et al.
4,571,092 A 2/1986 Switall
(Continued)

FOREIGN PATENT DOCUMENTS

CN 2233784 Y 8/1996
CN 1290292 A 4/2001
(Continued)

OTHER PUBLICATIONS

Chinese Office Action with English translation dated Dec. 22, 2015 in Chinese Patent Application No. 201480003543.7 (18 pages total).
(Continued)

*Primary Examiner* — Mark Halpern
(74) *Attorney, Agent, or Firm* — Dentons US LLP

(57) ABSTRACT

The present application relates to a mixer and a mixing method and, more specifically, to a pipe-type mixer for low-flow dispersion of immiscible liquids. The mixer, according to the present application, comprises: a pump (30) provided in a liquid transport section so as to supplement a deficient flow velocity, when materials to be mixed such as liquids are mixed through a continuous mixing step; and static mixers (22) suitable for the dispersion of the materials to be mixed by increasing a diameter of mixing parts (20) provided in a circulation pipe (10). Thus, a mixing rate of mixed materials can be more efficiently increased when the materials are mixed by using the static mixers (22).

1 Claim, 3 Drawing Sheets

(58) Field of Classification Search
USPC ..... 366/137
See application file for complete search history.

(56) References Cited

U.S. PATENT DOCUMENTS

| | | | |
|---|---|---|---|
| 5,372,421 | A | 12/1994 | Pardikes |
| 2011/0128814 | A1 | 6/2011 | Hanada |
| 2011/0199855 | A1 | 8/2011 | Hanada |

FOREIGN PATENT DOCUMENTS

| | | | |
|---|---|---|---|
| CN | 102451624 | A | 5/2012 |
| JP | 6-22428 | Y2 | 6/1994 |
| JP | 10-192682 | A | 7/1998 |
| JP | 11-333279 | A | 12/1999 |
| JP | 2000-140591 | A | 5/2000 |
| JP | 2001-335520 | A | 12/2001 |
| JP | 2002-018249 | A | 1/2002 |
| JP | 2002-113342 | A | 4/2002 |
| KR | 20-0401831 | Y1 | 11/2005 |
| KR | 10-2006-0095981 | A | 9/2006 |
| KR | 10-2011-0043607 | A | 4/2011 |
| KR | 10-2011-0054058 | A | 5/2011 |
| WO | 2009-014147 | A1 | 1/2009 |

OTHER PUBLICATIONS

Japanese Office Action dated Dec. 14, 2015 in Japanese Patent Application No. 2015-541705 (12 pages).

【FIG. 1】
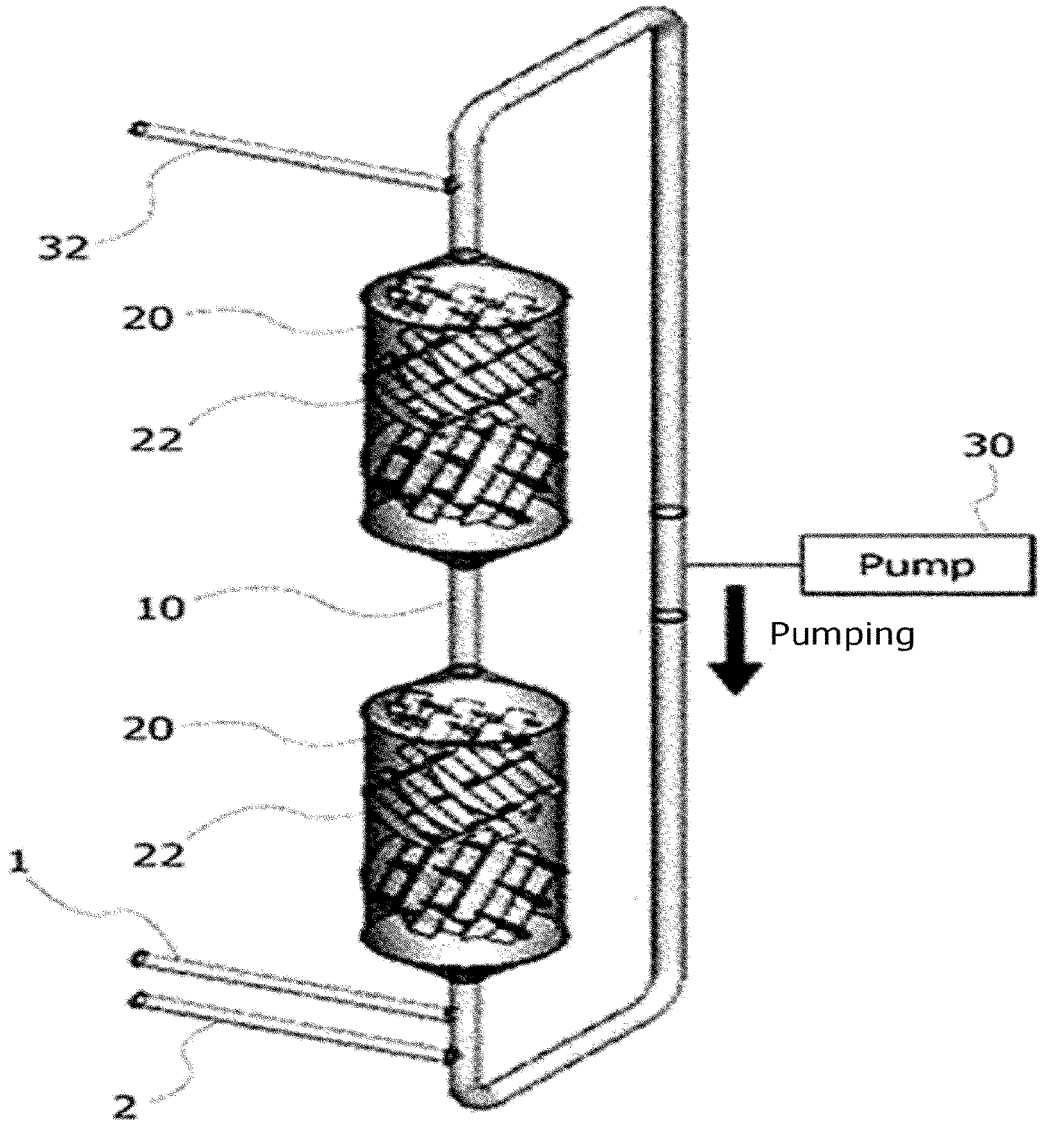

【FIG. 2】
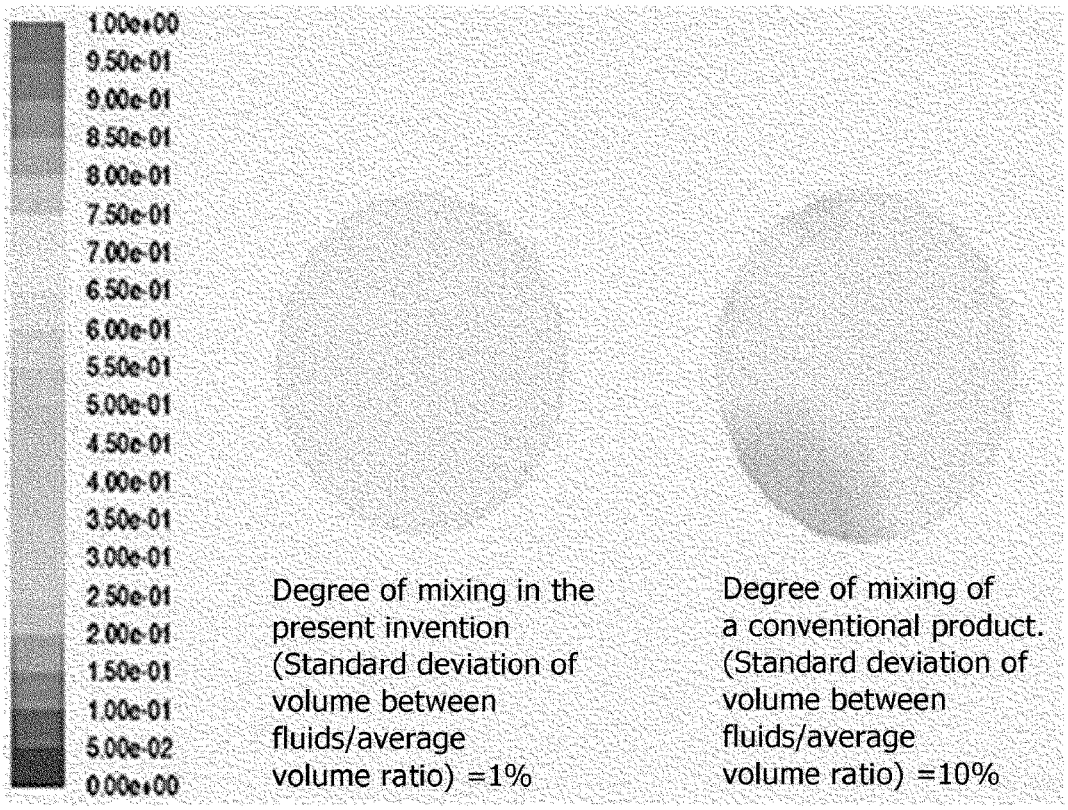

【FIG. 3】
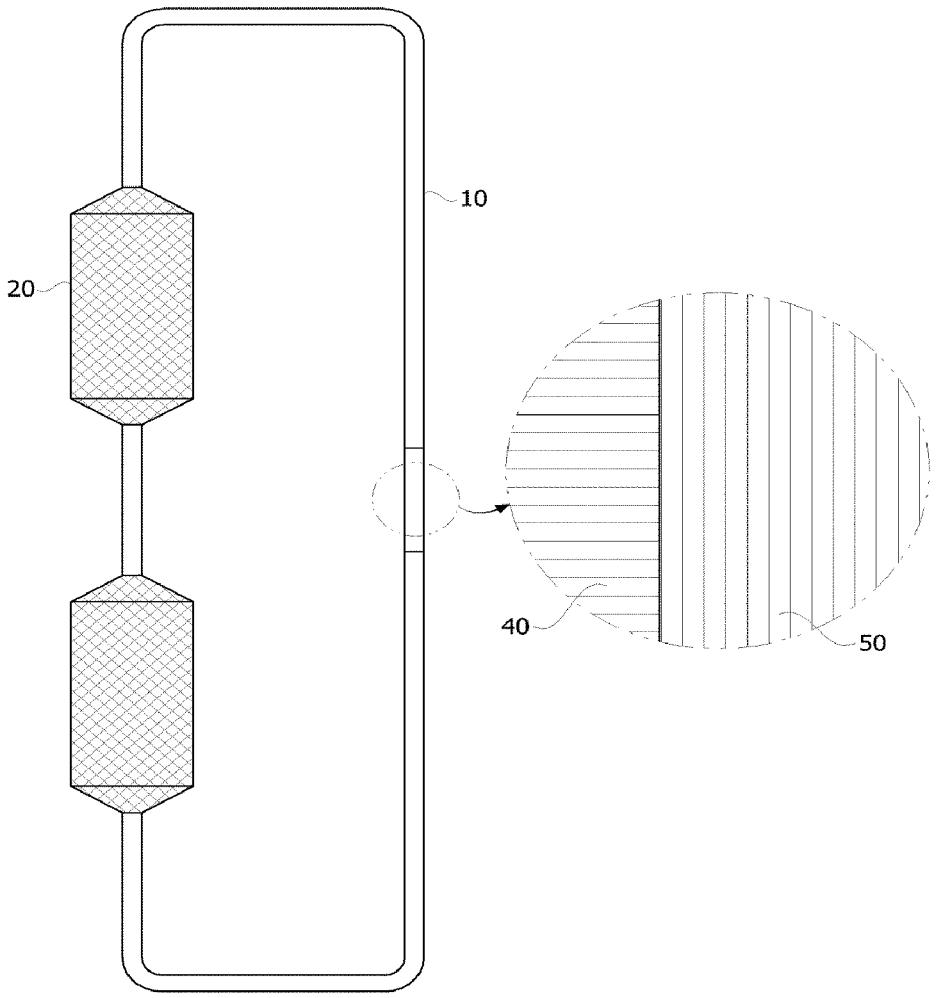

MIXER

This application is a National Stage Entry of International Application No. PCT/KR2014/001695, filed Feb. 28, 2014, and claims the benefit of Korean Application No. 10-2013-0022222, filed on Feb. 28, 2013, all of which are hereby incorporated by reference in their entirety for all purposes as if fully set forth herein.

TECHNICAL FIELD

The present application relates to a mixing device and a mixing method.

BACKGROUND

A static mixer employing pipes may be used for mixing immiscible fluids which are not mixed with each other. Patent documents 1 and 2 disclose technologies for mixing fluids utilizing pipes.

However, it is difficult to achieve a sufficient dispersion between fluids through the conventional static mixer.

Therefore, development of a mixing device which can disperse immiscible fluids in a continuous mixing process to produce a mixture having a high degree of mixing has been required.

PRIOR ART DOCUMENT

Patent Document

Patent Document 1: KR Patent laid-open publication No. 2011-0054058

Patent Document 2: KR Patent laid-open publication No. 2011-0043607

DETAIL DESCRIPTION OF THE INVENTION

Technical Task

The present application provides a mixing device and a mixing method. More concretely, the present application provides a mixing device which can improve the problem in which fluids are not dispersed well due to an insufficient flow amount of fluids when fluids are mixed by a continuous process.

Technical Solution

The present application relates to a mixing device.

Hereinafter, a mixing device according to the present application is described in detail with reference to the accompanying drawings.

FIG. 1 is a view showing a configuration of one exemplary mixing device of the present invention.

As the entire shape, as shown in FIG. 1, the mixing device may have a pipe type structure in which fluids can be circulated.

In one example, the mixing device may include a circulation pipe (10) forming a closed loop shaped path in which mixed substances can be circulated; and mixing parts (20) provided on the closed loop shaped path of the circulation pipe (10). Here, a diameter of the mixing part (20) may be greater than that of the circulation pipe (10) at at least a region at which substances to be mixed are entered into the mixing part (20) from the circulation pipe (10).

The circulation pipe (10) has the space along which substances to be mixed can be moved, and this circulation pipe may be constructed so that substances can be circulated in the form of a closed loop. It is preferable that the closed loop have a length which is in the range of approximately 100 mm to 1,000 mm.

In addition, a sectional shape of the circulation pipe (10) may be the same as or different from that of the mixing part (20). The circulation pipe may have various sectional shapes without specific limitation. For example, the circulation pipe may have one or more sectional shapes selected from the group consisting of a triangular shape, a rectangular shape, a circular shape, a pentagonal shape, and a hexagonal shape.

A plurality of mixing parts (20) can be provided on the circulation pipe. The plurality of mixing parts (20) can be continuously provided along a flow passage of the circulation pipe (10). In another example, the plurality of mixing parts (20) can be provided along the flow passage of the circulation pipe (10) at regular intervals.

If substances to be mixed can be moved in the circulation pipe, a diameter of the circulation pipe (10) is not limited particularly. For example, the circulation pipe (10) may have the diameter which is in the range of 5 mm to 50 mm, 5 mm to 40 mm, 5 mm to 30 mm or 5 mm to 20 mm.

If substances to be mixed can be efficiently dispersed, a diameter of the mixing part (20) is not limited particularly. For example, the mixing part (20) may have the diameter which is in the range of 30 mm to 400 mm, 30 mm to 200 mm, 30 mm to 150 mm, 35 mm to 100 mm or 40 mm to 80 mm.

The diameter of the mixing part (20) may be generally greater than that of the circulation pipe (10).

In one example, a ratio (M/P) between a diameter (M) of the mixing part (20) and a diameter (P) of the circulation pipe (10) at a region at which substances to be mixed are entered into the mixing part (20) from the circulation pipe (10) can be in the range of 2 to 10, 2 to 9, 3 to 8, or preferably 4 to 8. Diameters of the circulation pipe and the mixing part are adjusted so that, at the region at which substances are entered into the mixing part (20) from the circulation pipe (10), the ratio between the diameter of the mixing part (20) and the diameter of the circulation pipe (10) is in the above range. Therefore, a flow can be changed when substances to be mixed are entered into the mixing part, and a dispersion of substances is more efficiently achieved. As a result, the entire degree of mixing for substances to be mixed can be significantly increased.

In another example, in addition, in order to efficiently achieve the dispersion of substances, a diameter of the region at which substances, which are entered into and mixed in the mixing part (20), are discharged from the mixing part (20), may be greater than that of the circulation pipe (10). In further another example, the diameter of the mixing part (20) may be entirely the same as that of the circulation pipe (10).

The mixing part (20) may include a static mixer (22). The term "static mixer" in this specification is the part which is conventionally utilized at the time of mixing substances, such as fluids, to be mixed, and may be called a "mixing nozzle".

In the mixing device according to the present invention, the diameter of the mixing part (20) is greater than that of the circulation pipe (10) to enable a plurality of static mixers (22) to be included in the mixing part. If the static mixer (22) has a shape which is suitable for a dispersion of substances in the mixing part (20), the shape of the static mixer is not particularly limited. However, given a degree of mixing, for example, it is preferable that the static mixer have a screw shape or a spiral shape. In addition, the plurality of static mixers (22) may be installed in the mixing part (20) in the various directions. Without a specific limitation, the static mixer (22) may be manufactured from known materials. For example, the static mixer may be manufactured from a plastic material through a molding process or a casting process.

The mixing device according to the present invention may include two or more mixing parts (20) or three or more mixing parts (20). For example, three or more, four or more, or five or more mixing parts (20) may be included in the mixing device and the upper limit of the number of the mixing parts is not particularly limited. However, the number of the mixing parts may be properly selected in the range of ten or less.

In a case where the mixing device includes two or more mixing parts (20), for example, an interval between the mixing parts (20) may be in the range of 2 to 10 times, 3 to 9 times, 4 to 8 times or 4 to 7 times of the diameter of the circulation pipe.

The mixing device according to the present invention may further include an inlet line provided for enabling a mixed substance to be entered into the circulation pipe (10).

In one example, the mixing device may further include inlet lines connected to the circulation pipe (10) and allowing a mixed substance to be entered into the circulation pipe via different paths.

The inlet lines may include a first inlet line (1) and a second inlet line (2) provided independently of the first inlet line (1). A first substance can be entered into the circulation pipe via the first inlet line (1) and a second substance can be entered into the circulation pipe via the second inlet line (2). The inlet lines need not necessarily consist of two inlet lines as shown in FIG. 1, but the inlet lines may include three or more, four or more, or five or more inlet lines, if necessary, in the light of kinds or the number of substances to be mixed and a degree of mixing of a mixed substance.

In one example, the mixing device may further include a pump (30) provided on the circulation pipe (10) to increase a flow rate of substances to be mixed. The element "pump" in this specification is provided in the circulation pipe (10) to repeatedly increase a flow rate of substances to be mixed, and may be called "a circulation pump". The pump (30) is provided for supplementing an insufficient flow rate of substances to be mixed in the continuous mixing process performed by the mixing device according to the present invention, and this pump can increase a flow rate of substances flowing in the circulation pipe (10) to more effectively achieve a dispersion of substances.

In the light of an increase of the flow rate of substances to be mixed, which is being moved in the circulation pipe (10), the pump (30) can be installed at a proper location. However, the location at which the pump is provided is not particularly limited. For example, the pump may be provided in the circulation pipe (10) or may be provided at an outside of the circulation pipe (10). In the latter case, the pump can be connected to the circulation pipe (10) via a connection means such as a pipe and the like.

In one example, the mixing device may further include an outlet line (32) for enabling substances mixed in the mixing part (20) to be discharged from the circulation pipe (10) to an outside.

The outlet line (32) is connected to a side of a discharging port of the mixing part (20) to enable a mixed substance to be discharged.

The present application is also related to a mixing method.

In one example, the above mixing method is a method for mixing first substance and second substance using the mixing device described as above, and the method may include circulating the first substance and second substance through a path in the form of a closed loop formed by the circulation pipe (10) and mixing the first substance and second substance in the mixing part (20).

The first substance and second substance may be immiscible substances which are not mixed with each other. If the first substance and second substance are immiscible substances which are not mixed with each other, the first and second substances are not particularly limited. For example, however, the first substance may be a water-based fluid and the second substance may be an oil-based fluid.

In addition to the mixing part (20) included in the mixing device, whiling moving in a part, that is, a path in the form of the closed loop formed by the circulation pipe (10), the first substance and second substance may also be mixed with each other. In this case, a moving rate of the first substance and second substance in the path may be in the range of 1 m/s to 10 m/s, 2.5 m/s to 9 m/s, 4 m/s to 8 m/s or preferably 4 m/s to 6 m/s.

In one example, the mixing method according to the present invention may be performed so that a mixing of the first substance and second substance satisfies the below Equation 1.

$$\frac{\sqrt{\frac{1}{N}\sum_{i=1}^{N}(C_i - C_m)^2}}{C_m} \times 100 \leq 5 \quad \text{[Equation 1]}$$

In the equation 1, "$C_m$" indicates an average area ratio or a concentration of the first substance or second substance, which is measured at a plurality of points in the circulation pipe, the area ratio or the concentration indicates a ratio of an area or a concentration occupied by the first substance or second substance in a sectional surface at the measuring point of the circulation pipe, and is calculated in a state in which the area of the above sectional surface is regarded as "1"; "N" indicates the number of the points in the circulation pipe or the mixing part, at which the area ratio or the concentration is measured, here, "N" is two or more; and "$C_i$" indicates an area ratio or a concentration of the first substance or second substance which is measured at a certain point in the circulation pipe.

The ratio mentioned in the above equation can be measured by a sensor provided for sensing a degree of mixing in the circulation pipe or in the mixing part, and means a ratio of a volume occupied by the first substance or second substance to the unit area.

A plurality of sensors for sensing the degree of mixing may be provided so that an average value of the ratio of the volume can be determined.

In the mixing method according to the present invention, the diameter of the mixing part (20) is greater than that of the circulation pipe (10) to allow the static mixer (22) employed for promoting the dispersion of substances to be easily installed, and the circulation pump (30) is installed at the region in which substances to be mixed are moved, to supplement the insufficient flow rate in the continuous mixing process and to enable the degree of mixing for immiscible fluids, which are being entered, to be efficiently increased.

Advantageous Effect

In the mixing device, in a case where substances such as fluids to be mixed are mixed by the continuous mixing process, the pump (30) may be installed at the region in which fluids are moved, to supplement the insufficient flow rate, and the diameter of the mixing part (20) provided on the circulation pipe (10) is increased to allow the static mixer (22), which is suitable for a dispersion of substances to be mixed, to be installed. Therefore, if substances are mixed by means of the mixing device of the present invention, it is possible to efficiently increase the degree of mixing of a mixed substance.

BRIEF DESCRIPTION OF THE DRAWINGS

FIG. 1 is a view showing schematically a configuration of a mixing device according to the present invention;

FIG. 2 is a view comparing a degree of mixing of substances in Example to that of substances in Comparative Example; and FIG. 3 is a sectional view of the part which is required for measuring a degree of mixing in Example and Comparative Example.

REFERENCE NUMERALS

1: First inlet line
2: Second inlet line
10: Circulation pipe
20: Mixing part
22: Static mixer
30: Pump
32: Outlet line
40: Area occupied by first substance
50: Area occupied by second substance

BEST MODE FOR CARRYING OUT THE INVENTION

Hereinafter, the present application is described in detail through Example of the present invention and Comparative Example to which the present application is not applied. However, a scope of the present application is not limited to Example disclosed below.

EXAMPLE

The mixing device constructed as shown in FIG. 1 was manufactured, and water and oil were mixed by using this mixing device. In the structure of the mixing device of FIG. 1, a length of the overall closed loop formed by the circulation pipe (10) was 540 mm and a diameter of the circulation pipe (10) was 10 mm. Two mixing parts (20) were provided on the closed loop of the circulation pipe (10), and the static mixer (22) was installed in each mixing part (20). A diameter of the mixing part (20) was 55 mm, a length of the mixing part was 110 mm, and an interval between the two mixing parts (20) was 52 mm. Water was entered into the first inlet line (1) of the mixing part and oil was entered into the second inlet line (2), and the water and oil were circulated along the circulation pipe (10) to perform a mixing process. In this process, the pump (30) was operated to adjust flow rates of the water and oil to approximately 5 msec.

Comparative Example

Without using the mixing device constructed as shown in FIG. 1, water and oil were mixed by using a Kenics mixer (Chemineer, Inc.) which has been known to mix conventional immiscible fluids.

Standard deviation values of the degrees of mixing of mixed substances obtained from the outlet line (32) according to the above Example and Comparative Example were measured through a computational simulation method by which a coefficient of variation (CoV) is calculated, and the measurement results are shown in FIG. 2. More concretely, the standard deviation values of the degrees of mixing were the values representing a ratio of an area, which was occupied by substances to be mixed and sensed by the sensor provided on the circulation pipe or the mixing part for measuring the degree of mixing, to a sectional area, and these values were obtained according to the Equation 1 as below.

$$\frac{\sqrt{\frac{1}{N}\sum_{i=1}^{N}(C_i - C_m)^2}}{C_m} \times 100 \leq 5 \quad \text{[Equation 1]}$$

In the equation 1, "$C_m$" indicates an average area ratio or a concentration of first substance or second substance, which was measured at a plurality of points in the circulation pipe, the area ratio or the concentration indicates a ratio of an area or a concentration occupied by the first substance or second substance in a sectional surface at the measuring point of the circulation pipe, and is calculated in a state in which the area of the above sectional surface is regarded as "1"; "N" indicates the number of the points in the circulation pipe or the mixing part, at which the area ratio or the concentration was measured, here, "N" is two or more; and "$C_i$" indicates an area ratio or a concentration of the first substance or second substance, which was measured at a certain point in the circulation pipe.

As may be ascertained from FIG. 2, the standard deviation value of the degrees of mixing measured in Example is more than approximately 10 times as high as the standard deviation value of the degrees of mixing measured in Comparative Example and this shows excellent mixing efficiency of Example.

The invention claimed is:

1. A mixing device, comprising;

a circulation pipe forming a path in the form of a closed loop, in which a first substance and a second substance to be mixed can flow, wherein the circulation pipe has a diameter in the range of 5 mm to 20 mm;

two or more mixing parts provided on the path in the form of the closed loop of the circulation pipe and comprising a static mixer, wherein each of the mixing parts has a diameter in the range of 40 mm to 80 mm;

a first inlet line connected to the circulation pipe and provided for enabling the first substance to be entered into the circulation pipe;

a second inlet line connected to the circulation pipe independently of the first inlet line and provided for enabling the second substance to be entered into the circulation pipe;

a pump for enabling the first substance and the second substance to be mixed to be moved along the path formed in the form of the closed loop by the circulation pipe;

an outlet line for enabling a mixed substance to be discharged from the circulation pipe; and a plurality of sensors installed at the circulation pipe or the two or more mixing parts and measuring an average area ratio or a concentration of the first substance or the second substance, wherein a diameter of each of the mixing parts is greater than that of the circulation pipe at at least a region at which the first substance and the second substance to be mixed are entered into each of the mixing parts from the circulation pipe, wherein a ratio (M/P) between a diameter (M) of each of the mixing parts and a diameter (P) of the circulation pipe at the region at which the first substance and the second substance to be mixed are entered into each of the mixing parts from the circulation pipe is 4 to 8, wherein the circulation pipe or each of the mixing parts has one or more sectional shape selected from the group consisting of a triangular shape, a rectangular shape, a circular shape, a pentagonal shape, and a hexagonal shape, and wherein an interval between the mixing parts is in the range of four times to seven times the diameter of the circulation pipe.

* * * * *